US005896592A

United States Patent [19]

Santa Cruz et al.

[11] Patent Number: 5,896,592

[45] Date of Patent: Apr. 27, 1999

[54] AUTOMATIC TOILET SEAT LIFTING DEVICE

[76] Inventors: Cathy D. Santa Cruz, 401 Canyon Way, #43, Sparks, Nev. 89434; Joseph John Francisco, P.O. Box 1316, Dayton, Nev. 89403

[21] Appl. No.: 09/012,118

[22] Filed: Jan. 23, 1998

[51] Int. Cl.[6] ..... A47K 13/10

[52] U.S. Cl. ..... 4/246.1; 4/241

[58] Field of Search ..... 4/246.1, 246.3, 4/241, 661, 246.2, 246.4, 246.5

[56] References Cited

U.S. PATENT DOCUMENTS

| | | | |
|---|---|---|---|
| 660,977 | 10/1900 | Taylor | 4/241 |
| 664,610 | 12/1900 | Healy, Jr. | 4/241 |
| 718,971 | 1/1903 | Becker | 4/241 |
| 933,830 | 9/1909 | Davis | 4/241 |
| 4,428,083 | 1/1984 | Chuang | 4/240 |
| 4,951,324 | 8/1990 | Lirette | 4/251 |
| 5,158,299 | 10/1992 | Otter | 273/186.2 |
| 5,341,518 | 8/1994 | Uhl | 4/236 |
| 5,437,063 | 8/1995 | Cotman | 4/241 |
| 5,458,089 | 10/1995 | Rymer | 119/162 |
| 5,461,733 | 10/1995 | McKee | 4/246.1 |
| 5,461,734 | 10/1995 | Faircloth | 4/246.1 |
| 5,488,744 | 2/1996 | Paananen | 4/246.2 |

*Primary Examiner*—David J. Walczak

[57] ABSTRACT

A toilet seat lifting device of very simple construction having substantially only three parts. Namely, an attachment bracket, an attachment rod, and a counter weight, which in combination with a pre-existing toilet seat, cooperate together to automatically lift and retain the toilet seat in an upright position.

12 Claims, 3 Drawing Sheets

FIG. 3
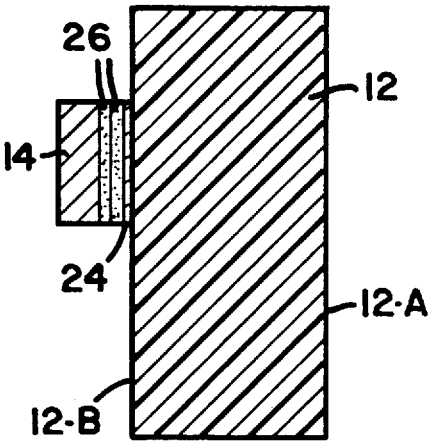
FIG. 4
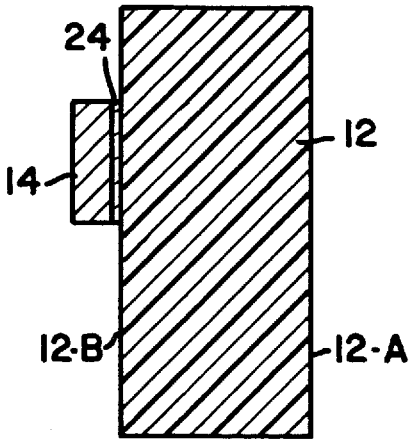
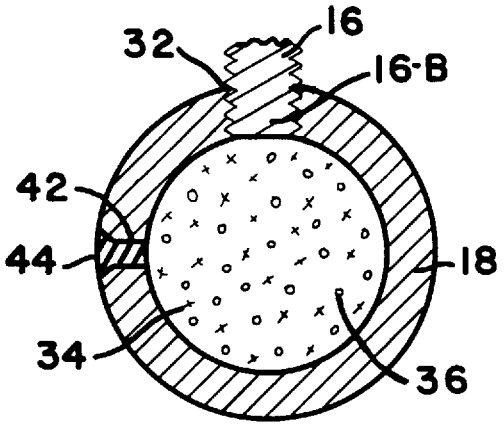
FIG. 5
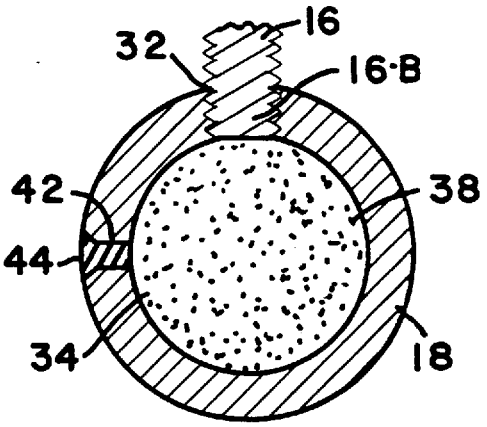
FIG. 6
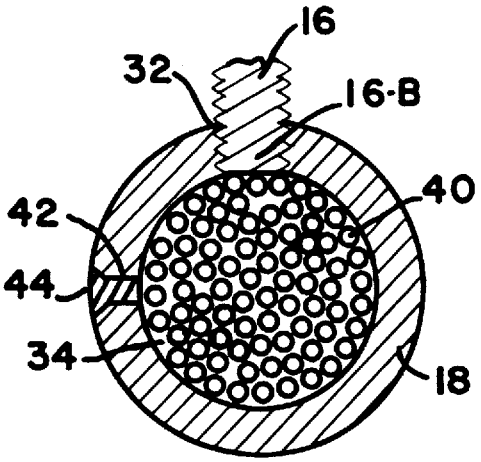
FIG. 7

AUTOMATIC TOILET SEAT LIFTING DEVICE

FIELD OF THE INVENTION

This invention relates to devices used to automatically lift a toilet seat, but more particularly pertains to a device comprising of only three parts, namely, an attachment bracket, an attachment rod and a counter weight, and no human intervention is required.

BACKGROUND OF THE INVENTION

In the past, numerous attempts have been made to provide an apparatus which will automatically lift a toilet seat into an upright position. Such attempts are exemplified within the following references:

U.S. Pat. Nos. 5,488,744 issued to Paananen, 5,461,733 issued to McKee, 5,437,063 issued to Cotham, 5,341,518 issued to Uhl and 4,951,324 issued to Lirette.

Each of the above noted references are substantially functional for their intended use, but each have inherent disadvantages which the present invention addresses and overcomes. For example, these devices are much to complicated and include numerous parts which the present invention eliminates, such as springs, cables, handles, etc.

Nowhere in the prior art did the applicants find a simple device which includes only three components, namely an attachment bracket, an attachment rod and a counter weight.

Therefore, it is contended by the applicants that there is a need for a device which automatically raises a toilet seat to an upright position, and more importantly is of simple construction, such as clearly taught by the present invention.

SUMMARY OF THE INVENTION

This device is more particularly designed for use with toilets found within men's public rest rooms, and is used to automatically raise a toilet seat to an upright position.

This invention is for sanitation purposes and helps prevent contamination of the top surface of the toilet seat during stand up use. It has been customary to allow a user of the toilet to raise, or lower, the seat as required.

However, experience in rest rooms has proven that users are most often careless in the proper use of a toilet, and will thoughtlessly leave the seat in its lowered position while urinating from a stand up position, thus, accidental spillage may occur, which is most unsanitary. Furthermore, this is most inconsiderate as the following user must clean the toilet before using.

Therefore, it is an object of the present invention to provide a device which will automatically raise a toilet seat to an upright position while not in use.

Another object of the present invention is to provide an automatic toilet seat lifting device which is of very simple construction, comprising of only three parts, namely, an attachment bracket, an attachment rod and a counter weight.

Yet another object of the present invention is to provide an automatic toilet seat lifting device which is easily removably attachable to substantially any existing toilet seat of choice, such as by either screws, VELCRO, bond material, or any other suitable attachment means of engineering choice may be used.

Yet another object of the present invention is to provide a toilet seat lifting device which can be attached on either the right or left side of the toilet seat, or any other location, or angle of user choice.

Still a further object of the present invention is to provide an automatic toilet seat lifting device which does not require any modification of the toilet seat.

Yet another object of the present invention is to provide an automatic toilet seat lifting device whereby, the toilet seat automatically remains in an upward position at all times, unless manually manipulated into a different position by the user.

A further object of the present invention is to provide an automatic toilet seat lifting device which helps to prevent the top side of the toilet seat from becoming contaminated by the stand up user.

Still another object of the present invention is to provide an automatic toilet seat lifting device which includes a counter weight, with the weight being heavier than the toilet seat, which causes the toilet seat to raise when not in use.

Yet another object of the present invention is to provide an automatic toilet seat lifting device which includes an attachment rod which is removably attachable to a counter weight.

A further object of the present invention is to provide an automatic toilet seat lifting device wherein the above noted attachment rod is made from substantially any suitable material of engineering choice, which allows a user to easily bend the rod into a position of choice, such as aluminum, or the like.

Also, another object of the present invention is to provide an automatic toilet seat lifting device which includes the previously mentioned counter weight being made from substantially any suitable material of engineering choice, such as cast iron, or the like.

Another object of the present invention is to provide an automatic toilet seat lifting device wherein the above noted counter weight is solid, and may be of any shape or size of engineering choice, such as in the form of a ball, or the like.

Yet another object of the present invention is to provide and automatic toilet seat lifting device wherein the afore mentioned counter weight is not solid, and provides an interior cavity. With the counter weight having filling means of engineering choice, such as a hole into the cavity and a plug, or the like.

Another object of the present invention is to provide an automatic toilet seat lifting device which includes the above noted filling means and thus, allows the counter weight to be filled with various types of weight means of engineering choice, such as sand, liquid, etc., or any other suitable weight means may be used.

Other objects and advantages will be seen when taken into consideration with the following specification and drawings.

BRIEF DESCRIPTION OF THE DRAWINGS

FIG. 3 is substantially a partial sectional view taken at 3—3 of FIG. 1.

FIG. 4 is substantially a partial sectional view taken at 4—4 of FIG. 2.

FIG. 5 is substantially a cross sectional view taken at 5—5 of FIG. 1 which includes a variable weight means therein.

FIG. 6 is substantially a cross sectional view taken at 5—5 of FIG. 1 which shows a different variable weight means than FIG. 5.

FIG. 7 is substantially a cross sectional view taken at 5—5 of FIG. 1 which shows a different variable weight means than FIGS. 5 & 6.

DETAILED DESCRIPTION OF THE DRAWINGS

Referring now in detail to the drawings wherein like characters refer to like elements through out the various views.

Figure 1:
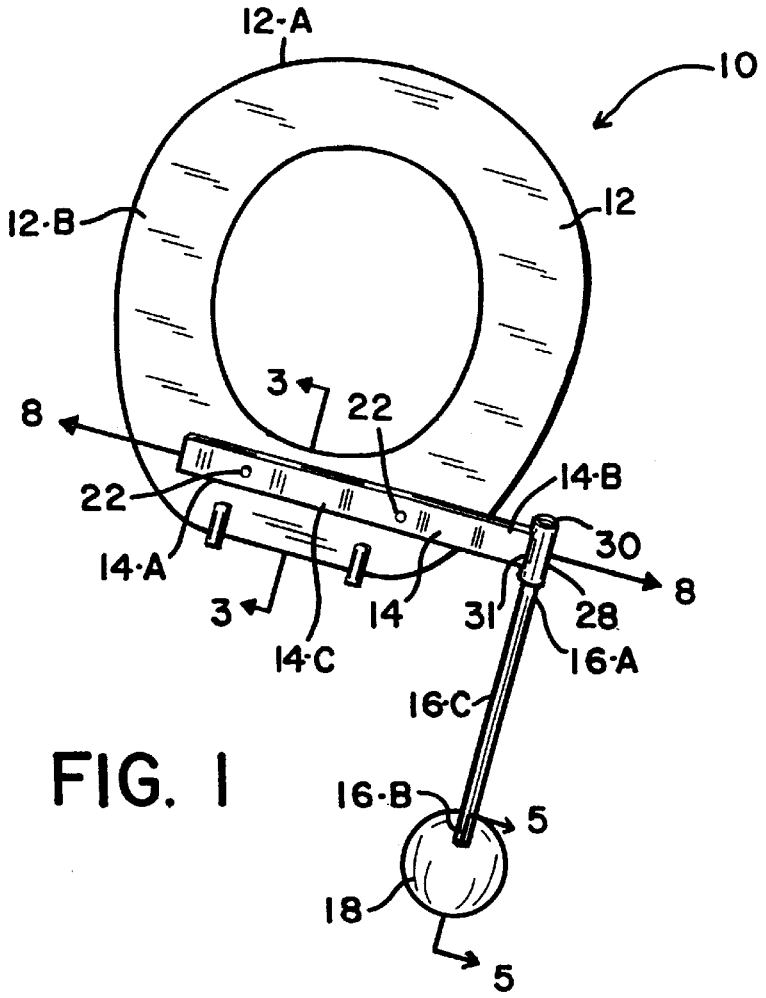
FIG. 1 is substantially a perspective view of the preferred embodiment for the present invention.
Figure 2:
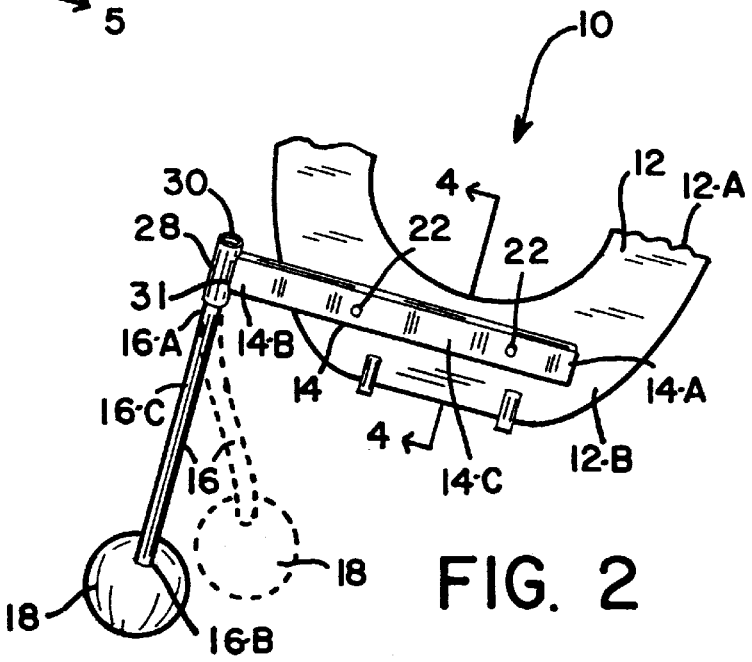
FIG. 2 is substantially a partial view showing a second position in ghost lines for a counter weight and rod.

In FIGS. 1 & 2, (arrow 10) represents an overview of present invention which is an automatic toilet seat lifting device and which is removably attachable to a pre-existing toilet seat (12), having a top surface (12-A), a bottom surface (12-B) and which is pivotable between an upright first position, and a downward second position. It is to be noted that any existing toilet seat of choice is acceptable, as the present invention is universally attachable to substantially any toilet seat, no matter what shape, size, or various material the seat (12) may be made from.

The present invention is of simple construction and includes substantially only three parts, an attachment bracket (14), an attachment rod (16) and a counter weight (18). Whereby, bracket (14), rod (16), counter weight (18) and toilet seat (12) in combination cooperate together to automatically lift and retain toilet seat (12) in its first upright position.

Bracket (14) may be substantially made from any suitable material of choice, such as wood, plastic, metal, etc. Also, bracket (14) may be formed into substantially any various shape or size of engineering choice. Such as bracket (14) may be in the form of an elongated rectangle having a first end (14-A), a second end (14-B) and provides an interconnecting section (14-C). It is to be noted that bracket (14) may include various attachment means of engineering choice for removably attaching bracket (14) to the bottom surface (12-B) of toilet seat (12). For example, in FIG. 8, we show interconnecting section (14-C) of bracket (14) having at least one threaded bore (20) there through and in FIGS. 1 & 2, (22) is a threaded screw which is of a shape and size to be threadably engaged within bore (20). It is to be noted that bracket (14) may include multiples of bore (20), and also bore (20) may be recessed if so desired.

Another alternative attachment means for removably attaching bracket (14) to the bottom surface (12-B) of toilet seat (12) is clearly illustrated within FIG. 3. Wherein we include a combination of a thin layer of glue (24) and a loop and pile fastener, such as interconnected VELCRO strips (26).

Yet another alternative attachment means for removably attaching bracket (14) to the bottom surface (12-B) of toilet seat (12) is clearly illustrated within FIG. 4. Wherein we provide only a thin layer of glue (24), or any other suitable bonding material may be used.

Referring now to bracket (14) which includes attachment means for removably attaching attachment rod (16) to bracket (14). Any suitable attachment means of engineering choice may be used. Such as a pipe (28) having a threaded bore (30), which is fixedly attached to either the first or second end (14-A) or (14-B) of bracket (14) by any suitable attachment means of engineering choice, such as by welding (31). It is to be noted that bracket (14) can be attached to toilet seat (12) on either the right or left side thereon, as clearly seen in FIGS. 1 & 2, depending on which end (14-A) or (14-B) of bracket (14) pipe (28) is attached to.

Referring now to attachment rod (16) which is substantially elongated having a first threaded end (16-A), a second threaded end (16-B), and an interconnecting section (16-C). Threaded bore (30) of pipe (28) is of a shape and size to threadably receive either the first threaded end (16-A), or second threaded end (16-B) of rod (16) therein. Whereby, either the first threaded end (16-A), or second threaded end (16-B) of rod (16), can be easily removably attached to bracket (14) by pipe (28).

Referring now to counter weight (18) which includes an internal threaded bore (32), as shown in FIGS. 5–8, which is of a shape and size to threadably receive either the first threaded end (16-A), or second threaded end (16-B) of rod (16) therein. Whereby, attachment rod includes attachment means for removably attaching counter weight (18) thereto, by threadably inserting either the first threaded end (16-A), or second threaded end (16-B) of rod (16) into bore (32).

It is to be noted that rod (16) is therefore adjustable in length, depending on how far rod (16) is threadably inserted into bore (30) and bore (32).

It is to be further noted that rod (16) may be made from substantially any suitable material of choice. However, the applicants have found that if the rod is made from a material which may be substantially easily manually manipulated into a position of choice, this is most advantageous. For example, if rod (16) is made from aluminum or the like, the installer may easily bend rod (16) into any desirable shape, thus installation is simplified and rod (16) is not only adjustable in length but is also adjustable between various positions, so as to fit different sized toilets having different clearances from the bathroom wall.

Referring now to counter weight (18) which can be made from substantially from any suitable material of engineering choice, such as cast iron, metal, aluminum, plastic, etc., and which can be made into substantially any shape or size of choice. For examples, see FIGS. 5–8, wherein we provide different embodiments for counter weight (18), each of which are described within the following specification.

In FIGS. 5–7, we show counter weight (18) being substantially ball shaped, having an interior hollow cavity (34) for receiving and retaining a variable weight means therein. It is to be noted that substantially any suitable weight means of engineering choice may be used, such as in FIG. 5, we show liquid (36) which can be any suitable liquid of choice, and which may include oil or the like, which not only adds weight but also helps to protect against rust.

Within FIG. 6, we show the variable weight means being sand (38) and in FIG. 7, we show variable weight means being buck-shot (40), or the like.

It is to be noted that variable weight means may be inserted into bore (32) of counter weight (18) before being attached to rod (16) by the installer, or the weight means may be inserted at the point of manufacture and secured in place by rod (16), depending on engineering and user choice.

Figure 8:
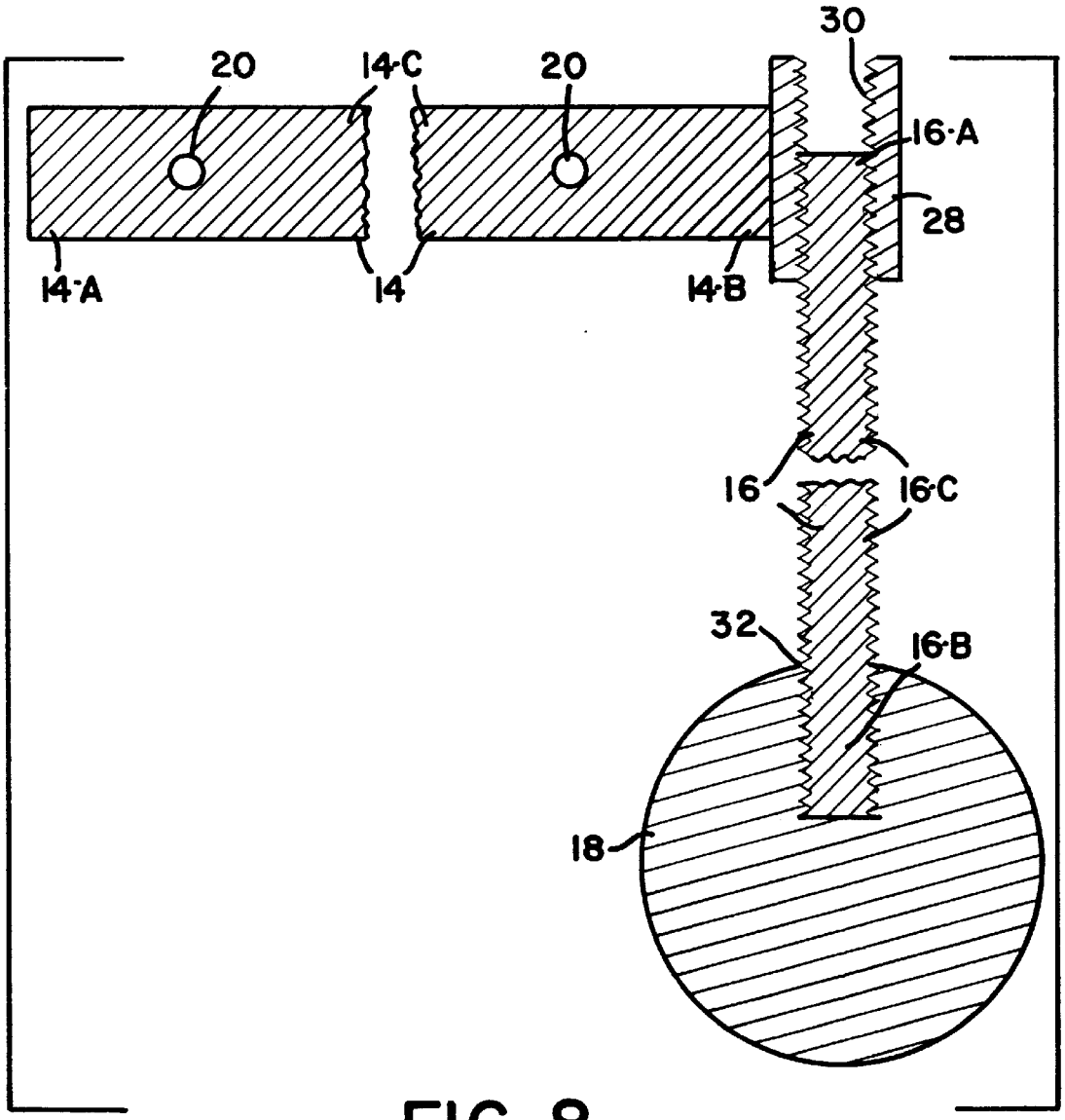
FIG. 8 is substantially a cross sectional view taken at 8—8 of FIG. 1.

In FIG. 8, we show the preferred embodiment for counter weight (18) which is substantially a solid ball having only one internal bore (32) and no variable weight means is provided.

Further shown within FIGS. 5–7, counter weight (18) includes a fill hole (42) and a plug (44) for filling and capturing variable weight means therein.

It is to be further noted we herein provide a method for attaching a toilet seat lifting device to a pre-existing toilet seat (12), comprising of the following steps:

a. positioning an attachment bracket (14) at a desired location of choice on toilet seat (12);

b. attaching the bracket (14) in place with at least one screw (22);

c. inserting a threaded rod (16) into a threaded pipe (28) which is fixedly attached to bracket (14); and d. inserting the threaded rod (16) into a threaded bore (32) within a counter weight (18).

Another method for attaching a toilet seat lifting device to a pre-existing toilet seat, is exemplified within the following steps:

a. applying a thin layer of glue (24) to attachment bracket (14);

b. positioning the attachment bracket (14) at a desired location of choice on toilet seat (12);

c. attaching bracket (14) in place with glue (24);

d. inserting threaded rod (16) into threaded pipe ((28) which is fixedly attached to bracket (14); and e. inserting threaded rod (16) into threaded bore (32) within counter weight (18).

It will now be seen we have herein provided a toilet seat lifting device which will automatically raise a toilet seat to an upright position while not in use.

It will further be seen we have herein provided an automatic toilet seat lifting device which is of very simple construction, comprising of only three parts, namely, an attachment bracket, an attachment rod and a counter weight.

It will also be seen we have herein provided an automatic toilet seat lifting device which is easily removably attachable to substantially any existing toilet seat of choice, such as by either screws, VELCRO, bond material, or by any other suitable attachment means.

It will still further be seen we have herein provided a toilet seat lifting device which can be attached on either the right or left side of the toilet seat, or any other location, or angle of user choice.

It will also be seen we have herein provided an automatic toilet seat lifting device which does not require any modification of the toilet seat.

It will further be seen we have herein provided an automatic toilet seat lifting device which includes a counter weight, with the weight being heavier than the toilet seat, which causes the toilet seat to raise when not in use.

Although the invention has been shown and described in what is conceived to be the most practical and preferred embodiment it is recognized that departures may be made therefrom within the scope and spirit of the invention, which is not to be limited to the details disclosed herein but is to be accorded the full scope of the claims so as to embrace any and all equivalent devices and or apparatuses.

Having described our invention, what we claim as new and desire to secure by Letters Patent is:

1. A toilet seat lifting device comprising: an attachment bracket; an attachment rod having first and second threaded ends; and a counter weight; said lifting device being removably attachable to a pre-existing toilet seat, said toilet seat having a top surface; a bottom surface; an upright first position; and a downward second position; said attachment bracket having attachment means for removably attaching said bracket to said bottom surface of said toilet seat at a location of choice, said bracket having attachment means in the form of a threaded tubular element having two opposite open ends engagable with one of said threaded ends of said attachment rod for removably attaching said attachment rod to said bracket, said counter weight being threadedly connected to said other threaded end of said attachment rod attachment rod, said bracket, said rod, said counter weight and said toilet seat in combination cooperate together to automatically lift and retain said toilet seat in said first upright position and wherein the distance said counter weight is spaced from said attachment means is adjustable by threading said rod through said tubular element.

2. The device of claim 1 wherein said attachment bracket is substantially in the form of a rectangle having a first end, a second end, and substantially an interconnecting section, said interconnecting section having at least one threaded bore there through, and said attachment means for removably attaching said bracket to said bottom surface of said toilet seat is by a threaded screw which is of a shape and size to be threadably engaged within said bore.

3. The device of claim 1 wherein said attachment means for removably attaching said bracket to said bottom surface of said toilet seat is by glue.

4. The device of claim 1 wherein said attachment means for removably attaching said bracket to said bottom surface of said toilet seat is by glue and a VELCRO fastener in combination.

5. The device of claim 1 wherein said rod is made from a material which allows said rod to be manually manipulated into a position of choice.

6. The device of claim 1 wherein said counter weight is substantially ball shaped having an interior hollow cavity for receiving and retaining a variable weight means therein.

7. The device of claim 6 wherein said counter weight includes a fill hole and a plug, for filling and capturing said variable weight means therein.

8. The device of claim 6 wherein said variable weight means is liquid.

9. The device of claim 6 wherein said variable weight means is sand.

10. The device of claim 6 wherein said variable weight means is buck-shot.

11. A method for attaching a toilet seat lifting device to a pre-existing toilet seat, comprising of the following steps:

a. positioning an attachment bracket at a desired location of choice on said toilet seat;

b. attaching said bracket in place with at least one screw;

c. inserting a threaded rod into a threaded pipe which has two opposite open ends and wherein said pipe is fixedly attached to said bracket;

d. inserting said threaded rod into a threaded bore within a counter weight; and e. adjusting the distance that said counter weight is spaced from said pipe by threading said threaded rod through said pipe.

12. A method for attaching a toilet seat lifting device to a pre-existing toilet seat, comprising of the following steps:

a. applying a thin layer of glue to an attachment bracket;

b. positioning said attachment bracket at a desired location of choice on said toilet seat;

c. attaching said bracket in place with glue;

d. inserting a threaded rod into a threaded pipe which has two opposite open ends and wherein said pipe is fixedly attached to said bracket;

e. inserting said threaded rod into a threaded bore within a counter weight; and f. adjusting the distance that said counter weight is spaced from said pipe by threading said threaded rod through said pipe.

* * * * *